United States Patent [19]

Wolfseder

[11] 4,205,762

[45] Jun. 3, 1980

[54] TWO-SHELLED CONTAINER

[75] Inventor: Alfred Wolfseder, Unterhaching, Fed. Rep. of Germany

[73] Assignee: Firma Gregor Hofbauer GmbH & Co., Munich, Fed. Rep. of Germany

[21] Appl. No.: 29,376

[22] Filed: Apr. 12, 1979

[30] Foreign Application Priority Data

Apr. 13, 1978 [DE] Fed. Rep. of Germany ..... 2816045

[51] Int. Cl.[2] ..... B65D 43/14; B65D 51/04

[52] U.S. Cl. ..... 220/334; 220/4 E; 16/128 R

[58] Field of Search ..... 220/334, 4 E, 339; 16/128 R, 171

[56] References Cited

U.S. PATENT DOCUMENTS

| | | | |
|---|---|---|---|
| 2,546,590 | 3/1951 | Ferrel | 16/128 R |
| 2,605,925 | 8/1952 | Morin | 16/128 R |
| 3,592,354 | 7/1971 | Nielson | 220/334 |
| 3,615,035 | 10/1971 | Newton | 220/334 |

*Primary Examiner*—George T. Hall

*Attorney, Agent, or Firm*—James E. Nilles

[57] ABSTRACT

A two-shelled container, such as a case, having shell portions hinged together by a band-shaped hinge joint attached in a form-locking manner. Each shell portion is adjacent and parallel to a support edge and a rib is provided having an undercut portion on its side facing away from the support edge. The hinge joint has two spaced, parallel, projecting holding rails with side surfaces that face toward each other and define mating undercut portions engaging the undercut portions provided on the two ribs. The distance between the mating undercut portions is dimensioned such that the hinge joint forces the shell portions into close contact along their support edges.

11 Claims, 4 Drawing Figures

FIG. 1
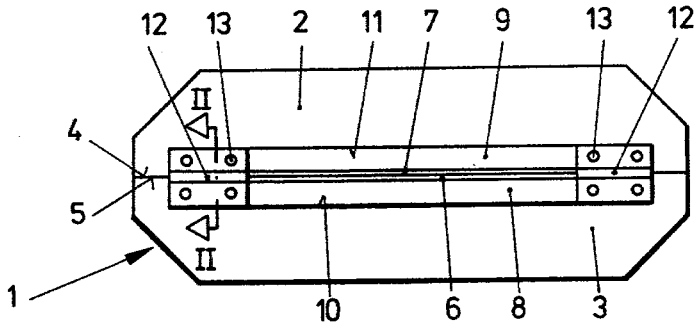
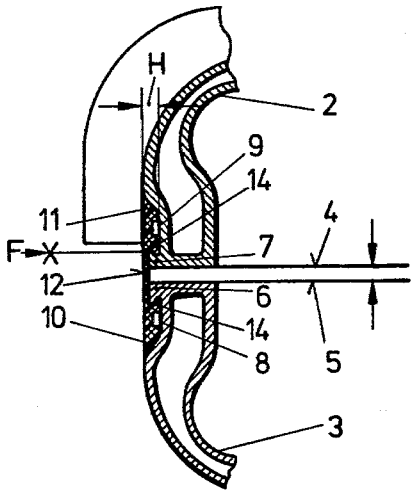
FIG. 2
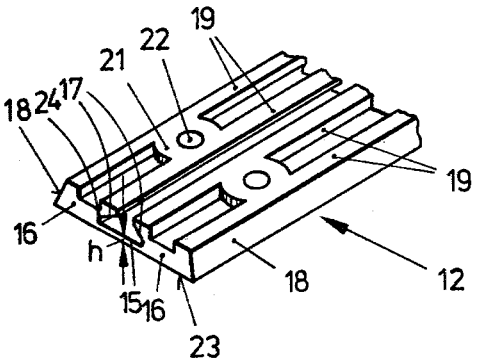
FIG. 3
FIG. 4
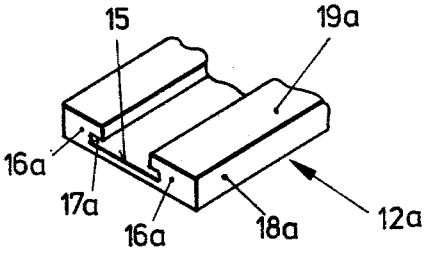

TWO-SHELLED CONTAINER

The invention relates to a two-shelled container, especially a case, according to the preamble of the main claim. From German Offenlegungsschrift No. 25 15 865 a container has been known wherein the two shell portions have, adjacent to their support edges, a rectangular immerged groove which is open to the exterior by means of a constricted neck portion. The shell portions are hinged together by means of a hinge joint having side edges that are thickened in accordance with the cross-section of the grooves and pressed into the grooves. This known container incurs the disadvantage that the wall portion in which the grooves are provided has to be extremely elastic so that the thickened edges of the hinge joint can be forced in. Nevertheless the forcing-in is a difficult and time-consuming operation. Another disadvantage resides in the fact that in particlar those portions of the shells where the grooves are located are subjected, when the container is packed full, to extreme deformation stresses as a result of the pulling action of the hinge joint, these deformations resulting in an undersirable gaping-open of the container in the area of the gap. Still another disadavantage is the fact that the hinge joint is planar and unstressed only when the container is in its open condition, whereas when the container is closed the hinge joint is bent by 90° and subjected to a tensioning stress. Since the container will only be open for being emptied or filled, the hinge joint is heavily stressed, whereby the durability of the hinge joint can be impaired. It is considered yet another disadvantage that when the container is in closed condition the hinge joint due to its being bent by 90°, cannot exert on the container shell portions as strong a closing force as would be possible, if it were straight and in unbent condition.

The object underlying the invention is to provide a container of the aforesaid type wherein the hinge joint can be attached more easily and is capable of exerting a great closing force for a long time, especially when the container is in closed condition. The features that are necessary with respect to the mounting of the hinge joint in a form-locking manner shall afford greater ease of manufacture than is the case with the known container.

In the case of a container of this type this object is attained according to the invention by the features recited in the characterizing portion of the main claim.

The formation of ribs at the shell portions is feasible with small expenditure as to the moulding technique especially if they are made as plastic parts by blow molding. In particular the removal of the molds from the blow-molded shell portions is clearly easier than in the case of the known shell portions. Furthermore, the hinge joint can be attached to the container more easily, since a simple pressing apparatus is the only thing necessary therefor or the joint can be snap-inserted by hand, respectively. A special advantage is afforded by the fact that the hinge joint in unbent when the container is in closed condition, whereby the hinge joint exerts a fairly great closing force on the shell portions. This also results in a much greater durability of the hinge joint, for it is only bent when the container is opened.

Apart from the demand for a strong form-locking or positive engagement between the hinge joint and the shell portions there is another important thing, namely, the ease of removing the shell portions from the mold, especially if they are made of a plastic material. In a preferred embodiment of the container according to the invention this is attained in an unobjectionable manner, if the features according to claim 2 are provided. The channels obviate the danger of formation cracks in the hinge joint after repeated opening of the container at those locations where the mating unercut surfaces join the connecting portion.

Another useful embodiment of a container acccording to the invention is distinguished according to claim 3. These features result in that the hinge joint is fitted very firmly to the shell portions, a biasing pressure forcing the mating undercut portions into snug engagement with the undercut portions of the ribs being produced in the holding rails as a result of the countersurfaces engaging the fitting surfaces.

Since such type containers are requisites of daily use which are to impart an optically pleasant overall impression and in the case of which projecting edges or corners are felt to be annoying, still another embodiment of the container according to the invention is designed in accordance with claim 4. Thus, the hinge joint which is flush with the backside of the container is incorporated in the container such that it can hardly be perceived from outside.

To prevent forceful or unintentional opening of the container in the region of the hinge joint, it is desirable not only to support the shell portions in a form-locking manner, but also to fix the hinge joint in a force-locking manner. This can be provided in still another embodiment of the container according to the invention designed in accordance with claim 5.

For straightforward securement of the hinge joint the features according to claim 6 are useful in this case.

Since the holding rails of the hinge joint do not primarily have a supporting function, but merely serve to safely lock the hinge joint in position, it is useful to proceed in accordance with claims 7 and 8, as is further suggested. Precisely the feature according to claim 7 makes it possible to save material in the product of the hinge joint.

Still another useful embodiment of a container according to the invention is recited in claim 9. This feature can already be realized in the production of the hinge joint so that the hinge joint can be fastened quickly without requiring any preparatory work.

Since a hinge joint made of a plastic material can be designed so as to possess great bending and tensile strengths, it is useful to proceed in accordance with claim 10, as has been done in still another embodiment of the container according to the invention. In this case the hinge joint is suitably produced separately of the container parts in the form of an elongate strip. Depending on requirements, individual sections are cut off the strip and fastened for connecting the shell portions to each other.

Still another important concept for an embodiment of the container according to the invention can substantially be noted from claim 11. In the case of shell portions having thin walls it may be useful to provide the hinge joint on the inner surface of the walls, whereby it is not exposed to external influences and provides a good seal for the gap area of the container from inside. If the hinge joint is provided on the inner surface of the shell portions and the latter are of greater wall thickness, it will be useful to chamfer the support edges outwardly such that the container can be opened easily. By means of such chamfering and the pulling action of the hinge joint it is possible at the same time to limit the extent to which the shell portions of the container can be hinged.

Embodiments of the subject matter of the invention will be explained hereinunder in detail with reference to the drawing in which FIG. 1 is a schematic rear view of a closed container, FIG. 2 is a sectional view of a portion of the container taking along the line II—II of FIG. 1.

FIG. 3 shows a section of a hinge joint in perspective view, and

FIG. 4 shows a perspective view of another embodiment of a hinge joint.

The container 1 a rear view of which is shown in FIG. 1 and which is preferably a case made of a plastic material by blow-molding consists of two shell portions 2 and 3 one of which is supported by the other along the support edges 4 and 5 and which are hinged together in the illustrated area. Adjacent to their support edges or along them the shell portions 2 and 3 are formed with ribs 6 and 7 which in the direction leading away from the support edges are adjoined by a submerged groove 8, 9. The grooves 8 and 9 are each limited on the side opposite to a rib 6 or 7 by a fitting surface 10 or 11, respectively. Into grooves 8 and 9 hinge joint sections 12 are pressed and fastened therein by fastening means 13 and, as can be seen from FIGS. 2 and 3, the hinge joint sections enclose the ribs 6 and 7 in a form-locking manner and press the container halves against each other along their support edges 4 and 5. It is of course also possible to provide a continuous hinge joint strip.

FIG. 2 is a detailed illustration of a sectional view of a hinge area. Each one of ribs 7 and 8 has on its side facing away from the support edges 4 and 5 an inclined undercut portion 14, the grooves 8 and 9 being each limited one one side respectively by one of said undercut portions 14. On the respective other sides of grooves 8 and 9 outwardly inclined fitting surfaces 11 and 10 are provided. Owing to the incline of the fitting surfaces 10 and 11 it is easy to remove the shell portions 2 and 3 from the molds despite the inclined undercut portion 14 that is provided on ribs 7 and 8, if the shell portions are made of a plastic material. The plane F separating the dies from each other will then suitably touch that edge of each rib 7 or 8 that leads to the undercut portion 14. In removing the dies the natural elasticity of the plastic material is utilized so that the core portion of the die which forms the grooves 8 and 9 in the shell portions 2 and 3 can be easily detached from the finished shell portion.

The hinge joint 12, FIGS. 2 and 3, is in the form of a planar strip whose central area serves as a connecting portion 15 for two laterally disposed holding rails 16 of greater thickness. The connecting portion 15 is designed as a so-called film hinge which possesses excellent flexibility and great tensile strength at the same time. The side surfaces of the holding rails 16 that face toward each other are designed as mating undercut portions 17 that are adapted for snug engagement with the undercut portions 14 provided on the ribs 7 and 8 of the shell portions 2 and 3. The outwardly facing side surfaces of the holding rails 16 form inclined countersurfaces 18 which are placed into contact with the fitting surfaces 10 and 11 of the grooves 8 and 9, if the hinge joint is forced over ribs 7 and 6 in the way as shown in FIG. 2. The upper surface of the holding rails 16 define the fastening portion 19 at which the hinge joint 12 can be fastened in grooves 8 and 9 in a force-locking manner by means of fasteners. For example, the fastening portions 19 can be secured in grooves 8 and 9 by adhesive bonding or fusing. The holding rails 16 further include longitudinal grooves 20 which mean a saving of material and contribute to a better fitting of the hinge joint in grooves 8 and 9. In case it is desired to fasten the hinge joint to the shell portions 2 and 3 by means of rivets or screws, holes 22 are spaced along the hinge joint 12 and surrounded by reinforced areas 21 to give the holes stability. The reinforced areas 21 can also be used, of course, as adhesive bonding or fusing points. The underside 23 of the hinge joint is planar. In order to make it possible to press the hinge joint 12 into the grooves 8 and 9 so as to obtain a flush outer surface the depth of grooves 8 and 9 or the height H of the fitting surfaces 10 and 11, respectively, exceeds the height of ribs 6 and 7 by the thickness h of the connecting portion. The transitional areas between the mating undercut portions 17 and the connecting portion 15 are in the form of rounded channels 24 in order to prevent in these strip-shaped zones heavy deflecting stresses on a material junction.

FIG. 4 shows a variant in the form of a hinge joint 12*a* whose undercut portions 17*a* are defined by rectangular surfaces which can cooperate in the same way with the undercut portions of the ribs which are then designed in a correspondingly mirror-iverted way. The countersurfaces 18*a* of the hinge joint 12*a* are perpendicular, and therefore the fitting surfaces of grooves 8 and 9 have also to be perpendicular. The hinge joint 12*a* further includes planar upper surfaces 19*a* as fastening portions which are secured in the grooves either by adhesive bonding or by means of screws. While it is more difficult to remove the hinge joint 12*a* and the correspondingly shaped receiving parts that are provided on the shell portions to receive the hinge joint 12*a* from the dies, the hinge joint 12*a* affords simplified manufacture and can be produced fully automatically as an endless plastic strip.

It is also possible, of course, to attach the hinge joints 12 or 12*a* to the inner surfaces of the shell portions, whereby they are protected against access from outside. In this case it will be necessary, however, if the shell portions have walls that are as thick as shown in FIG. 2, to outwardly chamfer the support edges such that they do not present an obstacle when the shell portions are hinged open. In this case the chamfered portions of the support edges will cooperate with the hinge joint in such a manner as to limit the extent to which the container can be hinged open.

I claim

1. A two-shelled container, especially a case, whose shell portions are hinged together by a band-shaped hinge joint attached in a form-locking manner, characterized in that on each shell portion (2, 3) and adjacent and parallel to the support edge (4, 5) thereof there is provided a rib (6, 7) having an undercut portion (14) on its side facing away from the support edge, that the hinge joint (12, 12*a*) comprises two spaced, parallel, projecting holding rails (16, 16*a*), the side surfaces thereof that face toward each other defining mating undercut portions (17, 17*a*) engaging the undercut portions provided on the two ribs, and that the distance between said mating undercut portions is dimensioned such that the hinge joint forces the shell portions into close contact along their support edges.

2. Two-shelled container according to claim 1, characterized in that said undercut portions (14) of said ribs (6, 7) are defined by surfaces that are inclined in the direction of said support edges (4, 5), and that said mating undercut portions (17) of said hinge joint (12) are inclined in the same manner and defined together with the connecting portion (15) of the hinge joint a dovetail cross-section having rounded channels (24) in the corners.

3. Two-shelled container according to claims 1 or 2, characterized in that each shell portion (2, 3) is provided with a groove (8, 9) which is defined on the one side by the undercut portion (14) of said rib (6, 7) and one the other side by a surface (10, 11) which is outwardly inclined relative to the bottom of said groove (8, 9), and that each holding rail (16) of the hinge joint (12) is sloped on the outer surface facing away from said mating undercut portion (17) to form a countersurface (18) adapted to be pressed against the respective fitting surface (10, 11).

4. Two-shelled container according to claim 3, characterized in that said fitting surfaces (10, 11) exceed the ribs (6, 7) in height by the thickness (h) of the connecting portion (15), that said hinge joint (12) has a planar rear surface (23) and is mounted within the grooves (8, 9) of said two shell portions such that when the container is in closed condition the rear surface of said hinge joint is flush with the back side of the container.

5. Two-shelled container according to claims 1 or 2 or 3 or 4 characterized in that the upper surfaces of said holding rails (16, 16*a*) are designed as mounting sections (19, 19*a*) at which said hinge joint (12, 12*a*) can be fastened to said shell portions (2, 3) by means of fastening means (13).

6. Two-shelled container according to claim 5, characterized in that said holding rails (16, 16*a*) are fastened to said shell portions by adhesive bonding or fusing or by means of screws or rivets (13).

7. Two-shelled container according to any one of claims 1 to 6, characterized in that each holding rail (16) has a longitudinal groove (20) on its surface that is adapted to be inserted into said groove (8, 9).

8. Two-shelled container according to claim 7, characterized in that said longitudinal groove (20) comprises fastening points (21) spaced over the length of said longitudinal groove (20).

9. Two-shelled container according to claim 8, characterized in that each fastening point (21) is a reinforced location comprising a hole (22) extending through said holding rail to receive a fastening means.

10. Two-shelled container according to claim 1, characterized in that said shell portions (2, 3) are interconnected by means of a plurality of short hinge joint sections (12) forced in position and fastened in spaced relationship.

11. Two-shelled container according to claim 10, characterized in that said hinge joint or said hinge joint sections (is) are provided on the outside of said container or on the inner surface thereof.

* * * * *